US008844970B2

(12) United States Patent
Gras et al.

(10) Patent No.: US 8,844,970 B2
(45) Date of Patent: Sep. 30, 2014

(54) ARMORED VEHICLE PROTECTED FROM EXPLOSIVE DEVICES

(71) Applicant: Nexter Systems, Roanne (FR)

(72) Inventors: Philippe Gras, Mably (FR); Vincent Desormiere, Roanne (FR)

(73) Assignee: Nexter Systems, Roanne (FR)

( * ) Notice: Subject to any disclaimer, the term of this patent is extended or adjusted under 35 U.S.C. 154(b) by 0 days.

(21) Appl. No.: 13/715,667

(22) Filed: Dec. 14, 2012

(65) Prior Publication Data

US 2013/0264808 A1 Oct. 10, 2013

(30) Foreign Application Priority Data

Dec. 16, 2011 (FR) ..... 11 03915

(51) Int. Cl.

| | |
|---|---|
| ***F41H 7/04*** | (2006.01) |
| ***F41H 5/013*** | (2006.01) |
| ***B62D 21/15*** | (2006.01) |
| ***B62D 21/10*** | (2006.01) |
| ***F41H 7/00*** | (2006.01) |

(52) U.S. Cl.

CPC . *F41H 7/00* (2013.01); *F41H 7/042* (2013.01)
USPC ..... 280/784; 296/187.07; 296/187.08

(58) Field of Classification Search

CPC ..... F41H 7/042; F41H 7/048; F41H 7/04; F41H 7/02; F41H 7/00
USPC ..... 280/784, 124.1; 180/312, 311, 89.1; 89/36.09, 36.08, 929; 296/187.03, 296/187.07, 187.08, 193.07
See application file for complete search history.

(56) References Cited

U.S. PATENT DOCUMENTS

| | | | | |
|---|---|---|---|---|
| 6,893,046 | B2 * | 5/2005 | Ledesma et al. | 280/788 |
| 2003/0010189 | A1 | 1/2003 | Zonak | |
| 2011/0088544 | A1 | 4/2011 | Bettencourt et al. | |
| 2012/0049570 | A1 * | 3/2012 | Aizik | 296/187.08 |

FOREIGN PATENT DOCUMENTS

| | | | | |
|---|---|---|---|---|
| EP | 0 828 134 | A2 | 3/1998 | |
| EP | 1 275 928 | A2 | 1/2003 | |
| EP | 1 921 416 | A1 | 5/2008 | |
| EP | 2 327 950 | A2 | 6/2011 | |
| GB | 457 156 | A | 11/1936 | |
| JP | 2001-187525 | A * | 7/2001 | B60G 9/04 |
| WO | WO 2009/150330 | A1 | 12/2009 | |

OTHER PUBLICATIONS

Search Report issued in French Patent Application No. 1103915 dated Sep. 24, 2012 (with translation).
Written Opinion issued in French Patent Application No. 1103915 dated Sep. 24, 2012 (with translation).

* cited by examiner

*Primary Examiner* — Keith Frisby
(74) *Attorney, Agent, or Firm* — Oliff PLC

(57) ABSTRACT

The subject-matter of the invention is an armored vehicle comprising a vehicle body forming a passenger compartment which is connected to mobility means comprising at least two axles. The axles of the vehicle are connected to the vehicle body by at least one axle support which has the shape of a U-shaped profile arranged above an axle and comprising a middle plate attached to the axle and extended by side edges which extend substantially vertically between the axle and the vehicle body, wherein each side edge bears at least one connecting tab which is attached by its end to the vehicle body at an attachment point.

7 Claims, 4 Drawing Sheets

ARMORED VEHICLE PROTECTED FROM EXPLOSIVE DEVICES

CROSS REFERENCE TO RELATED APPLICATIONS

Applicant claims priority under 35 U.S.C. 119 of French patent application no. 1103915 filed on Dec. 16, 2011.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The invention belongs to the technical field of armored vehicles and their protection from the explosions of mines or improvised explosive devices.

2. Description of the Related Art

Mines, and particularly blast mines as well as improvised explosive devices, constitute nowadays one of the major threats to armored vehicles on the battlefield.

The blast generated by the explosion of such a device, near or below the body of a vehicle, results in extremely high mechanical stresses causing the rupture of the floor of the vehicle body and the violent projection of the mobility elements (axles, bridges, differentials . . . ) against said vehicle body.

In order to protect the vehicle body and the crew who occupies it, providing additional protections or shieldings between the vehicle body and the mobility means has been suggested.

These protections have the effect of making the vehicle heavier.

It has also been suggested in the European patent EP1921416 to provide a protection plate which is connected to the vehicle body by deformable supports. Such a solution also makes the vehicle heavier and has also the effect of reducing the ground clearance of the vehicle.

From the European patent EP1275928 is also known a vehicle ventral protection comprising a concave plate connected to the vehicle body by inclined sidewalls. The vehicle axles are secured at the side plates which are welded to the vehicle body and pass therethrough at openings. Thus, during a shock related to the initiation of a mine under the vehicle, the axles are violently projected toward the vehicle body without any damping.

BRIEF SUMMARY OF THE INVENTION

An object of the invention is to provide an armored vehicle architecture wherein a protection from the projection of the mobility elements as a result of the initiation of an explosive device, below or near the vehicle, is ensured, without thereby making the vehicle heavier or substantially modifying the ground clearance thereof.

The invention therefore relates to an armored vehicle comprising a vehicle body forming a passenger compartment connected to mobility means comprising at least two axles, wherein the axles are connected to the vehicle body by at least one axle support which has the shape of a U-shaped profile arranged above an axle and comprising a middle plate attached to the axle and extended by side edges which extend substantially vertically between the axle and the vehicle body, each side edge bearing at an upper end at least one connecting tab which extends laterally with respect to the middle plate and the end of the at least one connecting tab is attached to the vehicle body at an attachment point, the connecting tabs being arranged below and spaced from the bottom of the vehicle body, thereby allowing a deformation of the connecting tabs without impacting the support on the bottom of the vehicle body.

Advantageously, the side edges of the U-shaped profile are rigidified with respect to the middle plate by welded reinforcements.

The U-shaped profile may be formed as a folded sheet forming the middle plate, the side edges and the connecting tabs.

The armored vehicle according to the invention may comprise an axle support for each axle.

According to another embodiment, each axle support may comprise a lower stirrup which will be arranged between the U-shaped profile and the axle, wherein the stirrup is secured to the connecting tabs at the attachment points and is arranged below beams of the chassis.

The beams of the chassis may be arranged between the stirrup and the U-shaped profile, a gap being provided between the stirrup and each beam to allow a deformation of the stirrup.

The middle plate of the U-shaped profile will be applied against a middle wall of the stirrup.

BRIEF DESCRIPTION OF THE SEVERAL VIEWS OF THE DRAWING

Other advantages of the invention will appear from the following description of a particular embodiment, description made with reference to the appended drawings, in which.

DETAILED DESCRIPTION OF THE INVENTION

Figure 1:
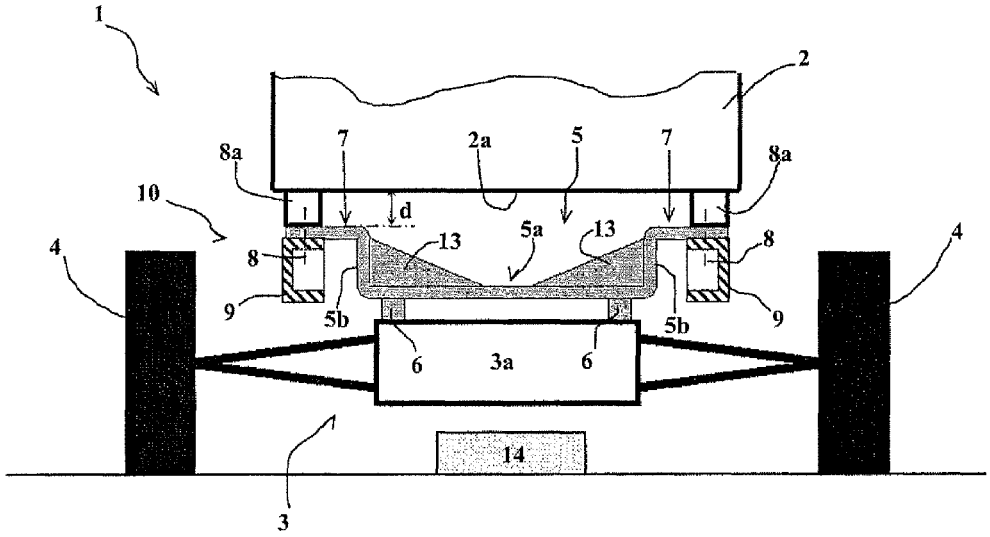
FIG. 1 is a schematic cross-section view of a vehicle according to an embodiment of the invention, cross-section made at an axle.

FIG. 1 schematically shows the lower part of a vehicle 1 which comprises a vehicle body 2 forming a passenger compartment for a crew. This vehicle body 2 is connected to a chassis 10 bearing mobility means which comprise in this embodiment at least two axles 3, each carrying two wheels 4.

Figure 2:
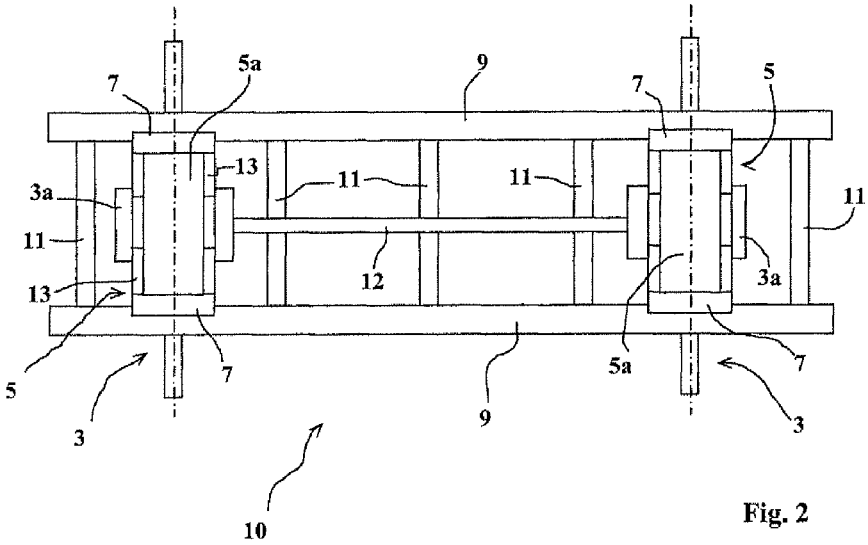
FIG. 2 is a top view of a vehicle chassis according to the invention comprising two axles.

The chassis 10 is partly constituted by two beams 9 which are connected to each other by transversal side-members 11 (not shown in this figure but visible in FIG. 2).

A single axle 3 is shown in FIG. 1 formed as a block 3*a*, enclosing e.g. a differential. Axle 3 is connected to the beams 9 of the chassis 10 as well as to the vehicle body 2 by at least one axle support 5.

This support 5 has the shape of a U-shaped profile comprising a middle plate 5*a* which is attached to axle 3 by bolted studs 6. The plate 5*a* is extended by side edges 5*b* which extend substantially vertically between the axle 3 and the vehicle body 2. Each side edge 5*b* bears at an upper end at least one connecting tab 7 which extends laterally with respect to the middle plate 5*a* and the end of the at least one connecting tab is attached to the vehicle body 2 as well as to the beam 9, at an attachment point 8.

The connecting tab 7 is thus supported on beam 9 of chassis 10. The attachment point 8 is constituted e.g. by bolts (of which only the axis is shown) which extend through beam 9 and from tab 7 to a block 8*a* secured to the vehicle body 2.

As seen in FIG. 1, the connecting tabs 7 are arranged at a distance d from the bottom 2*a* of the vehicle body 2 and they each have a substantially horizontal part between attachment point 8 and side edge 5*b* of U-shaped profile 5.

FIG. 2 shows partially and from the top the beams 9 of the chassis as well as two U-shaped profiles 5. The vehicle body and the wheels are not visible in FIG. 2. It can be noted that each U-shaped profile 5 is arranged above an axle 3 and covers a block 3*a* (e.g. a differential). The differentials 3*a* are connected by a shaft 12.

FIG. 2 also allows to see the tabs 7 of each U-shaped profile 5 supported on the beams 9.

Each U-shaped profile 5 is formed as a folded sheet which forms the middle plate 5*a*, the side edges 5*b* and the connecting tabs 7.

It can also be noted in FIGS. 1 and 2 that each U-shaped profile 5 has its side edges 5*b* rigidified with respect to the middle plate 5*a* by reinforcements 13 which are welded to the folded plate.

Figure 3:
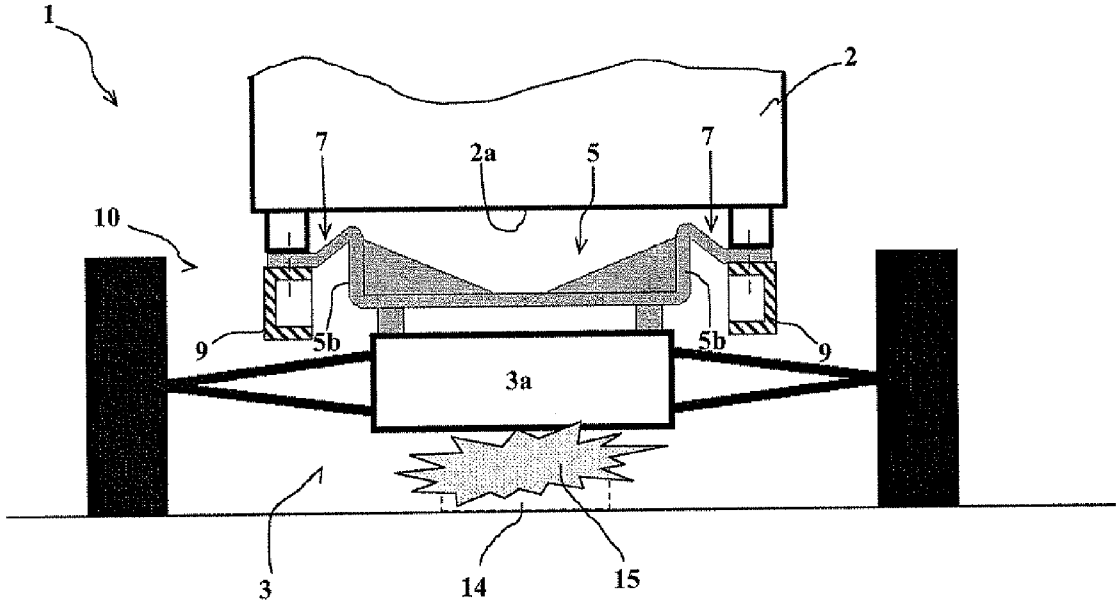
FIG. 3 is a view similar to FIG. 1 showing the vehicle following the initiation of an explosive device.

In FIG. 1 is schematically shown an explosive device 14 arranged below axle 3. FIG. 3 shows vehicle 1 according to the invention after explosion of device 14. The effect of the blast 15 generated by the explosive device causes a vertical movement of axle 3 toward the vehicle body 2.

The connecting tabs 7 are distorted by the impact and bend. The U-shaped profile 5 therefore moves toward the vehicle body 2 without impacting it.

The energy of the impact and of the blast is largely absorbed by the deformation of the connecting tabs 7.

Thus, a violent impact of axle 3 on the bottom of the vehicle body 2 is prevented. The invention therefore allows to define in a relatively simple manner a vehicle whose resistance to mine blasts is improved. This reinforcement is ensured without a significant increase of the ground clearance of the vehicle.

The resistance and deformation characteristics of U-shaped profile 5 are determined in particular by the sizing of connecting tabs 7 and by that of the reinforcements.

The welded reinforcements 13 allow to reduce the deformation of the body of U-shaped profile 5. The deformations are then localized at the tabs 7. Since the tabs 7 are at a distance from the bottom 2*a* of the vehicle body 2, their deformation occurs without mechanical interferences with the vehicle body 2.

The connecting tabs 7 comprise in this embodiment a substantially horizontal part between attachment point 8 and side edge 5*b* of U-shaped profile 5. Alternatively, the tabs could be inclined, e.g. upwardly, between side edge 5*b* and attachment point 8. However, such an alternative will increase the ground clearance of the vehicle.

Figure 4:
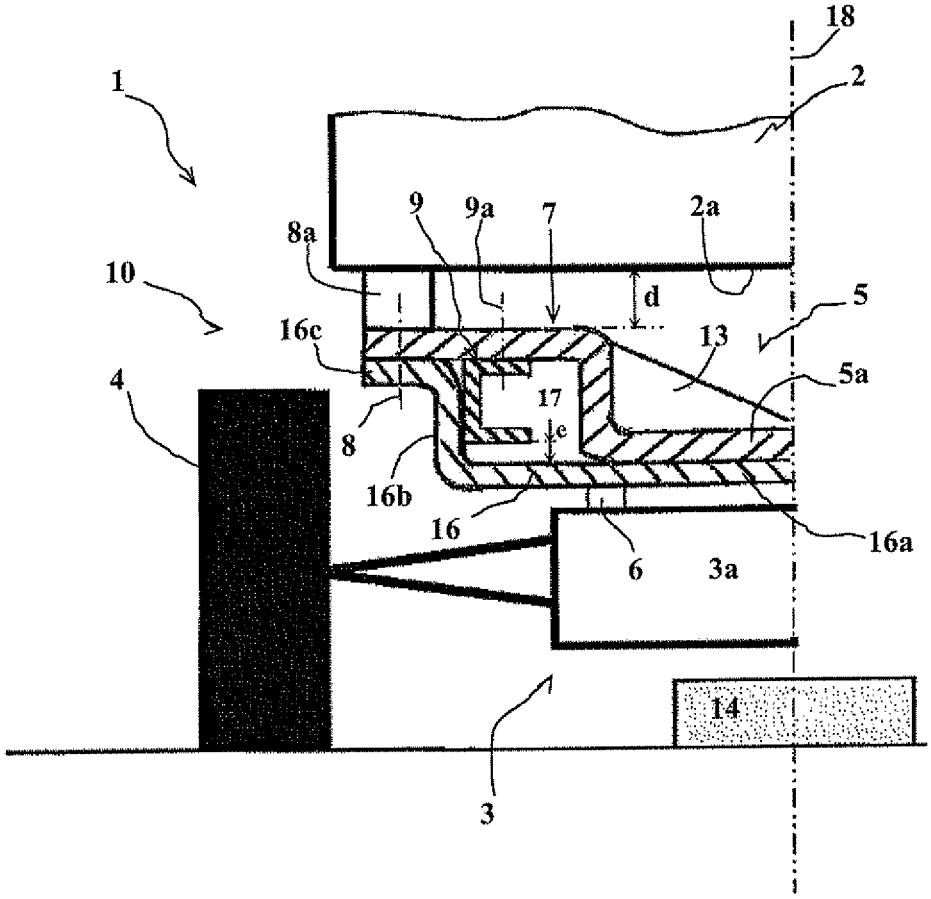
FIG. 4 shows a schematic half-section view of a vehicle according to another embodiment of the invention, half-section made at an axle.
Figure 5:
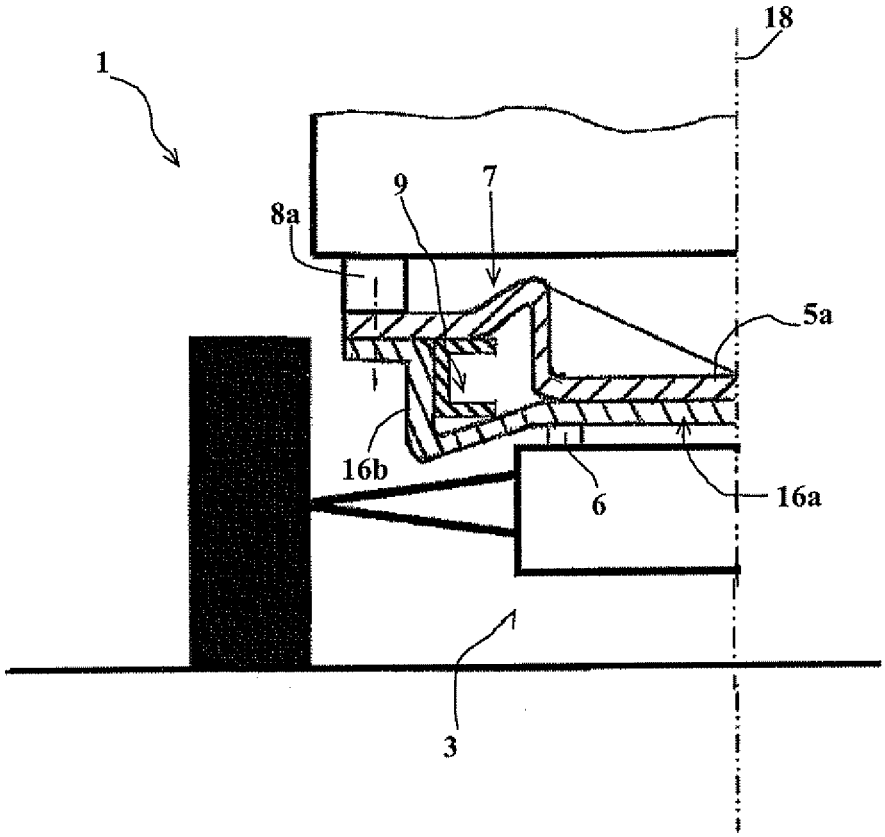
FIG. 5 is a view similar to FIG. 4 showing the vehicle following the initiation of an explosive device.

FIGS. 4 and 5 show another embodiment of the vehicle according to the invention. These figures are half-views. The several elements shown are symmetrical with respect to the vertical plane 18.

Similarly to the preceding one, this vehicle comprises at least one axle support 5 under the shape of a U-shaped profile and arranged above each axle.

This embodiment differs from the previous one in that each axle support further comprises a lower stirrup 16 which is arranged between U-shaped profile 5 and axle 3.

The stirrup 16 is secured to the connecting tabs 7 at the attachment points 8 to the vehicle body 2. This stirrup 16 is formed as a folded sheet metal plate, which has substantially the same width as U-shaped profile 5, and which has a middle wall 16*a* that is applied against middle plate 5*a* of U-shaped profile 5. The middle wall 16*a* is extended on each side by a wing 16*b* which is perpendicular to the middle wall 16*a* and which ends with a fold 16*c* that is applied against connecting tab 7 at attachment point 8.

The stirrup 16 is arranged below the chassis beams 9. Each beam 9 is thus trapped in a volume 17 defined by U-shaped profile 5 and stirrup 16.

As seen in FIG. 4, the middle wall 16*a* of the stirrup 16 is arranged at a distance from the beam 9. A gap e is thus provided between stirrup 16 and each beam 9. This gap allows a deformation of stirrup 16 as will be described below.

The U-shaped profile 5 is also attached to each beam 9 by connecting means 9*a* (screw or bolt) whose axis only is shown in FIG. 4.

U-shaped profile 5 and stirrup 16 are attached together to axle 3 at bolted studs 6.

As in the previous embodiment, the connecting tabs 7 are arranged at a distance d from the bottom 2*a* of the vehicle body 2.

FIG. 5 shows vehicle 1 after explosion of an explosive device 14 under axle 3. The blast effect causes a vertical movement of axle 3 toward the vehicle body 2.

The connecting tabs 7 are deformed by the impact and bend. Furthermore, stirrup 16 is also deformed and its middle wall 16*a* also bends between wings 16*b* and the attachment studs 6. The middle wall 16*a* is stopped in its deformation by the beams 9. The U-shaped profile 5 moves toward the vehicle body 2 and the impact energy is absorbed both by the deformation of the connecting tabs 7 and by the deformation of stirrup 16. This embodiment allows, with a reduced vertical bulk, to further increase the absorption capacities of the deformations. Furthermore, the abutment effect of beams 9 secures the device by preventing any impact of U-shaped profile 5 against the floor 2*a* of the vehicle body.

Sequence Listing

Not Applicable

The invention claimed is:

1. An armored vehicle comprising a vehicle body forming a passenger compartment connected to mobility means comprising at least two axles, wherein the axles are connected to the vehicle body by at least one axle support which has the shape of a U-shaped profile arranged above an axle and comprising a middle plate attached to the axle and extended by side edges which extend substantially vertically between the axle and the vehicle body, each side edge bearing at an upper end at least one connecting tab which extends laterally with respect to the middle plate and only the end of the at least one connecting tab is attached to the vehicle body at an attachment point with a substantially horizontal part of the at least one connecting tab between the attachment point and the side edge, the connecting tabs being arranged below and spaced from the bottom of the vehicle body, thereby allowing a displacement of the axle support and the axle upwards through a deformation of the substantially horizontal part of the connecting tabs without impacting the axle support on the bottom of the vehicle body.

2. An armored vehicle according to claim 1, wherein the side edges are rigidified with respect to the middle plate by welded reinforcements.

3. An armored vehicle according to claim 1, wherein the U-shaped profile is formed as a folded sheet forming the middle plate, the side edges and the connecting tabs.

4. An armored vehicle according to claim 1, wherein it comprises an axle support at each axle.

5. An armored vehicle according to claim 1, wherein each axle support comprises a lower stirrup which is arranged between the U-shaped profile and the axle, the lower stirrup being secured to the connecting tabs at the attachment points and a portion of the lower stirrup being arranged below beams of the chassis.

6. An armored vehicle according to claim 5, wherein the beams of the chassis are arranged between the lower stirrup and the U-shaped profile, a gap being provided between the lower stirrup and each beam to allow a deformation of the lower stirrup.

7. An armored vehicle according to claim 5, wherein the middle plate of the U-shaped profile is applied against a middle wall of the lower stirrup.

* * * * *